United States Patent [19]

MacIntyre

[11] Patent Number: 4,600,972

[45] Date of Patent: Jul. 15, 1986

[54] EMERGENCY LIGHTING APPARATUS

[75] Inventor: Hazen L. MacIntyre, Los Angeles, Calif.

[73] Assignee: Hazenlite Incorporated, Santa Monica, Calif.

[21] Appl. No.: 643,553

[22] Filed: Aug. 23, 1984

[51] Int. Cl.[4] ..... F21S 9/02; F21V 19/04

[52] U.S. Cl. ..... 362/20; 362/147; 362/183; 362/240; 362/269; 362/427

[58] Field of Search ..... 362/145, 20, 147, 157, 362/183, 184, 185, 187, 188, 189, 190, 191, 197, 198, 199, 232, 238, 239, 240, 241, 249, 250, 251, 269, 294, 370, 371, 372, 418, 419, 422, 427, 428, 429, 430, 432

[56] References Cited

U.S. PATENT DOCUMENTS

| | | | |
|---|---|---|---|
| 1,392,165 | 9/1921 | Hunter | 362/187 |
| 1,537,780 | 5/1925 | Oefinger | 362/432 X |
| 1,697,170 | 1/1929 | Ermold | 362/432 |
| 2,508,071 | 5/1950 | Martin et al. | 362/20 X |
| 3,837,607 | 9/1974 | Hesse | 362/418 X |
| 4,096,553 | 6/1978 | Roche | 362/183 |
| 4,214,185 | 7/1980 | Breeze | 315/86 |
| 4,218,725 | 8/1980 | Heffner et al. | 362/183 X |
| 4,245,281 | 1/1981 | Ziaylek, Jr. | 362/372 X |
| 4,245,284 | 1/1981 | Moore et al. | 362/432 X |
| 4,255,746 | 3/1981 | Johnson et al. | 340/577 |
| 4,464,707 | 8/1984 | Forrest | 362/371 X |

OTHER PUBLICATIONS

"Dual-lite EZ-1", Dual Lite Emergency Lighting Division, May 1980.

*Primary Examiner*—Willis R. Wolfe

*Attorney, Agent, or Firm*—Paul D. Supnik

[57] ABSTRACT

An emergency lighting fixture has a capped circular and longitudinally slotted tube containing a power supply and charging electronics. Cylindrical outer envelopes rotatably enclosing the tube each have pivotally mounted lamp shells at opposing ends. A spider plate attachable canopy having integrally molded apertured inner lugs has an outer integrally molded arm supported overhanging portion, the arm being of substantial cross section for supporting the tube weight centrally supporting the lighting fixture. The tube has a longitudinal support slot receiving a rectangular support piece terminating from the canopy arm. End caps enclosing tube ends each have a circumferential groove for receiving guide nubs are disposed in spaced apart relationship on the inner circumference of the envelopes. The envelopes have oblique truncated surfaces allowing beam positioning without envelope interference. Installation is achieved by affixing the spider to an outlet box, joining the wires of the outlet box to those from the canopy, and affixing the canopy to the spider plate. The support portion of the canopy is slid into the tube slot and tube, the envelopes are fitted over the tube and polarized electrical connectors are joined. Beam adjustment is effected by envelope rotation and shell pivoting, without significantly changing the overall cylindrical appearance of the fixture.

24 Claims, 8 Drawing Figures

EMERGENCY LIGHTING APPARATUS

BACKGROUND OF THE INVENTION

1. Field of the Invention

This invention pertains to lighting apparatus. In particular, the invention relates to self contained emergency lighting fixtures.

2. Description of the Prior Art

In recent years, emergency lighting fixtures have been required for office buildings and structures which automatically are actuated in the event of power failures. Emergency lighting fixtures which activate upon loss of AC utility normally utilize separate lighting heads which are mounted either remote from or integrated to a rectangular box which separately contains charger, transfer relay and batteries. This equipment is shipped from the factory either with batteries installed but not connected, requiring an on site connection, or with batteries shipped separately requiring on cite installation and connection. The products have substantially been limited to the "lunch pail" or "bug eye" design. The combination of style and design along with ease of installation has not been a significant consideration.

As a result, a desirable fixture has not been available which also maintains a decorative appearance, yet can function according to required standards and is simple to install by the building contractor.

SUMMARY OF THE INVENTION

Emergency lighting apparatus in accordance with this invention generally has a housing support such as a canopy for attachment to a building structure such as a standard electrical junction box, and a housing. The housing, coupled to the support, encases electronics including a power supply, and also partially encloses a beam adjustable lamp head. The power supply and electronic circuitry, which powers the lamp head independently of a utility voltage in the event of a power outage, is confined within the housing and is electrically coupled to the lamp head. The housing support carries the full weight of the housing, including power supply and lamp head.

In a more specific example the housing has an inner tube enclosed by end caps confining the power supply and electronics and juxtaposed cylindrical outer envelopes, each supporting at opposing ends a lamp head, yet covering and partly rotatable about the tube. The housing support has a cantilever arm having an extending portion. A slotted track in the tube receives the extending portion of the cantilever arm which supports the entire weight of the housing. The envelopes pivotally support the lamp heads providing beam adjustment about an axis along an envelope diameter.

Additional features in accordance with this invention include lamp shells pivotally coupled to the circular envelopes supporting the lamp heads and allowing adjustment along an axis along the tube diameter, and an oblique sliced surface adjacent outermost portions of the envelopes to allow the lamp beam to be adjusted without envelope interference. A stick lock insertable in the tracking slot affixes the protruding portion of the cantilever arm of the canopy, maintaining the positioning of the cantilever arm relative to the tube. Guide nubs on the interior of the envelopes pressure snapped into tracking grooves on the end caps of the tube maintain the lateral positioning of the envelopes over the tube and allow rotation of the envelopes providing beam adjustment about the tube axis. Thus beam adjustment is available about two perpendicular axes while maintaining a uniform cylindrical decorative appearance.

BRIEF DESCRIPTION OF THE DRAWINGS

The nature of the invention described herein may be best understood and appreciated by the following description taken in connection with the accompanying drawings in which.

DETAILED DESCRIPTION

Figures 1, 2:
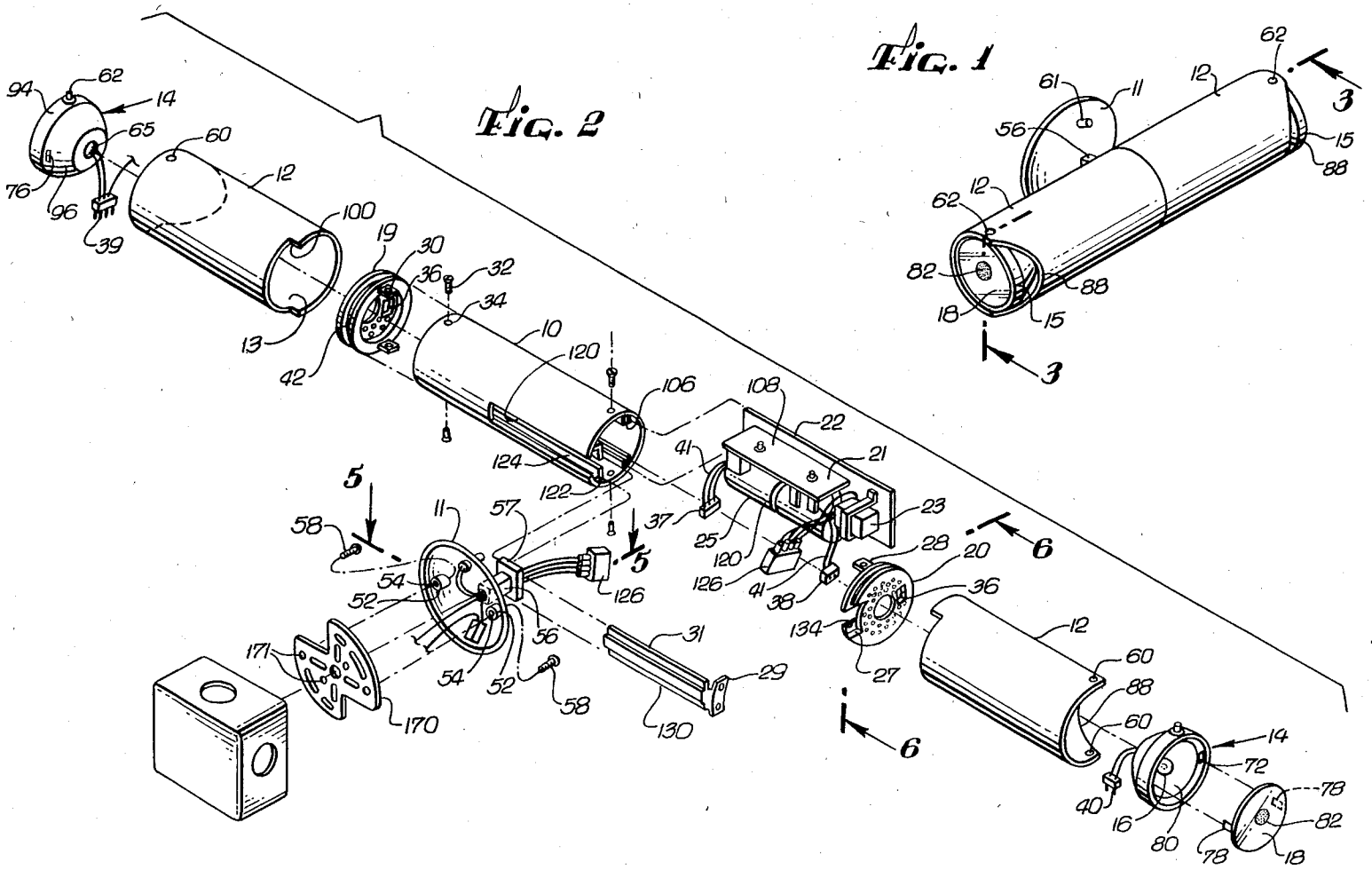
FIG. 1 is a perspective view of an emergency lighting fixture in accordance with this invention.
FIG. 2 is an exploded perspective view of the emergency lighting fixture depicted in FIG. 1.
Figure 6:
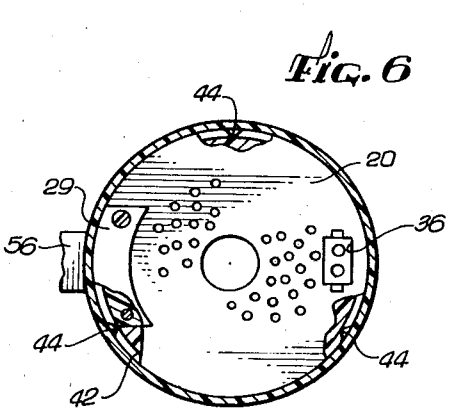
FIG. 6 is an elevational view of a portion of the invention depicted in FIG. 1 taken along lines 6—6 of FIG. 2.

With particular reference to FIGS. 1, 2, 3, 4, 5 and 6, an emergency lighting fixture in accordance with this invention generally comprises a housing having an inner tube 10 of plastic such as Lexan brand polycarbonate plastic, generally 0.120 inches (0.3 cm) thick for encasing electronic apparatus for the fixture, a housing support or canopy 11 for supporting the tube 10 and a pair of juxtaposed outer cylindrical half envelopes 12 for providing an attractive exterior housing and each envelope 12 supporting a separate lamp head 14. The half envelopes 12 have cylindrical inner surfaces 13 defining inner diameters mating with outer surfaces of the inner tube 10, to provide a skin tight, though rotatable fit, as best viewed in FIG. 2 and 3. The U.L. standards for this type of device generally require a minimum thickness of 0.058 inches (0.15 cm.), and the thickness used in this application is more than twice that required by such standards. Thus the housing, which includes both the tube 10 and the envelopes 12 both encases the electronic apparatus as well as supports the lamp heads 14.

Adjacent to and pivotally coupled at extreme ends of the envelopes 12 are pivotable lamp shells 15 for supporting lamps 16 and lenses 18.

At each end of the tube 10, end caps 19, 20 are provided for enclosing circuitry including a charger board 21, transformer 23 and a battery 25 attached to a circuit board support plate 22 therein. The end caps 19, 20 comprise outer annular portions 24 and thinner centrally disposed ventilation screens 26. The end cap 20 has a rectangular recessed surface 27 for receiving an overhanging portion 29 of a stick lock 31. The annular portion 24 has a a pair of facing normally directed legs 28 having threaded apertures 30 for receiving mounting screws 32 through countersunk apertures 34 adjacent ends of the tube 10. The end caps 19, 20 have rectangular apertures 36 into which fit female receptacles 37, 38. The female receptacles 37, 38 are required to connect the lamps 16, by accepting male plugs 39, 40 of the lamps 16. However, the female receptacle 37 is a three circuit connector for providing an automatic battery connection circuit, the third circuit simply being a mike connection to complete the contact of a battery circuit on the charger board 23.

A circumferential groove 42 extends about the annular portion 24 of each end cap 19, 20. The groove 42 is pressure fit to receive three inwardly directed guide nubs 44 spaced apart 120 degrees about an inner circumference of the envelopes 12, thereby allowing rotation of the envelopes 12 about the inner tube 10 for adjusting the positioning of the lamp heads 14, and generally fixing the lateral positioning of the envelopes 12 to the tube 10. The nubs 44 are pressure snapped into the circumferential groove 42 of the end caps 19, 20.

Figure 4:
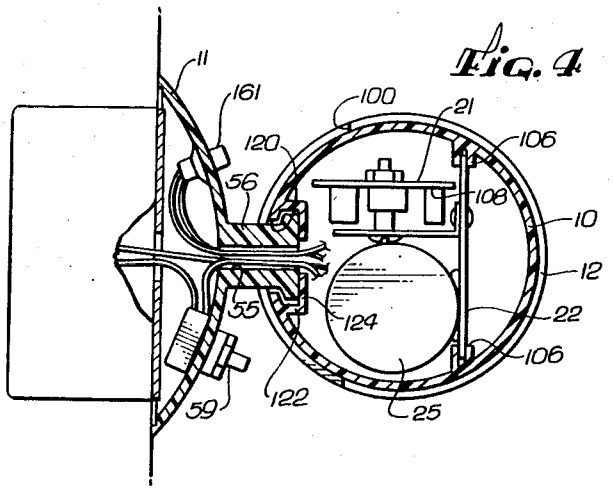
FIG. 4 is a cross-sectional view with portions exposed and portions removed taken along lines 4—4 of FIG. 3.
Figure 3:
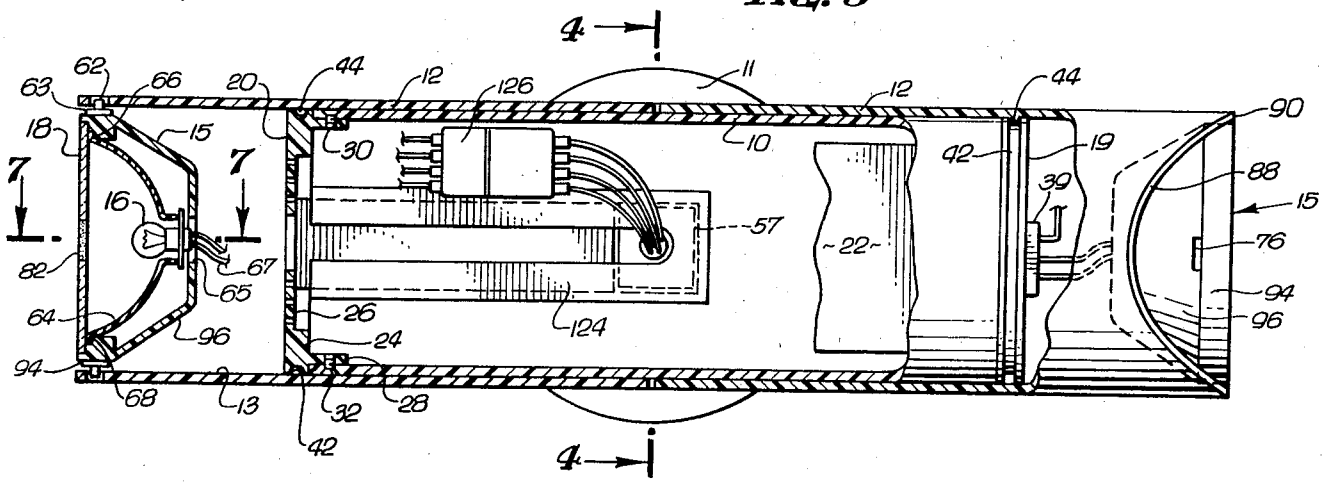
FIG. 3 is a a cross-sectional view with portions exposed and portions removed taken along lines 3—3 of FIG. 1.
Figure 5:
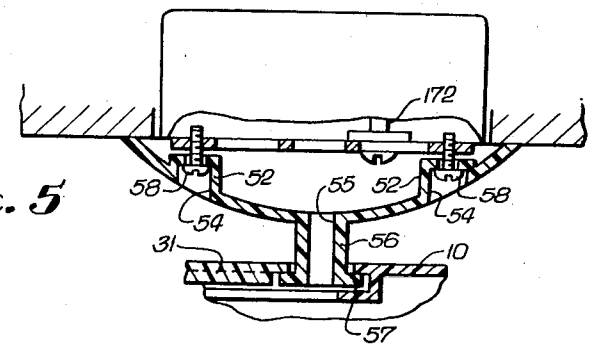
FIG. 5 is a cross-sectional view with portion exposed and portions removed taken along lines 5—5 of FIG. 2.

With particular reference to FIGS. 2, 3 and 4, the canopy 11 comprises integrally molded plastic such as a Lexan polycarbonate plastic having inner cylindrical lugs 52 having internal longitudinal apertures 54 and a short rectangular cantilever arm 56 having an aperture 55 for passing through electrical wires, yet having a substantial cross sectional area which, in combination with the reinforcing effect of the screws 58 disposed within the lugs 52, provides a fixture support of significant strength. The cantilever arm 56 has a rectangular, rather than a square cross section, to provide a proper match within the slot provided in the tube 10. Strength and integrity in the canopy 11 is important, since the tube 10 and its contents and supporting materials may weigh perhaps 5 pounds (2.2 kilograms) and the arm 56 must support that entire weight. Integral molding provides both strength and ease of installation. The arm 56 has a rectangular end portion 57 having edges extending over the arm, for engaging the tube 10. The canopy 11 has a press to test normally closed switch 59 and a red LED AC pilot light 61.

Figure 7:
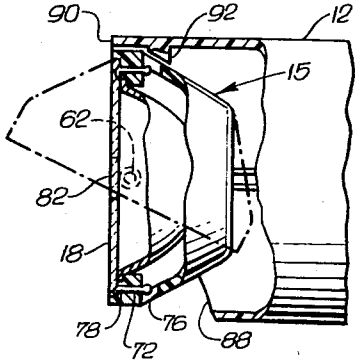
FIG. 7 is an elevation view with portions exposed and portions removed of the invention depicted in FIG. 1.

As best viewed in FIGS. 3 and 7, the lamp shells 15 comprise integrally molded circular elements each having outwardly extending pivot pins 62 and adjacent bearing surfaces 63, disposed along a diametric axis adjacent the opening end of the shells 15 for pivotally mounting the lamp shells 15 within the confines of the envelopes 12. The pivot pins 62 define a rotational axis for adjustment of the lamp shells 15. Apertures 60 are disposed along a diametric axis adjacent the outermost portion of the envelopes 12 to receive the pivot pins 62 of the shells 15. The envelopes 12, being of 0.120" (0.3 cm.) polycarbonate are sufficiently flexible to allow the envelopes 12 to be squeezed by hand, along an axis normal to the axis of the pivots, to enlarge the space between the apertures 60 permitting the pivot pins 62 of the shell 15 to be placed within the envelopes 12. The shells 15, are then rotatable within the envelopes 12 for adjustment of the lamp. The shells 15 have a concave interior region for receiving a reflector 64, and a circular aperture 65, typically ¼ inch (0.6 cm) round to allow passage of wires 67 from lamp sockets coupled to the lamps 16, to the plugs 39, 40.

The reflector 64, comprising ABS plastic material, is impaled into the shell 15 by the lenses 18. The reflector 64 has an annular lip 66 which bears on an annular 1 mm lip surface 68 of the shells 15.

A pair of lens receiving slots 72 along opposite sides of a diametric axis normal to the pivot axis of each reflector shell 15 are disposed parallel to the shell axis, through opposing portions of an annular ring surface 74 adjacent the lip surface 68. Adjacent and beneath each slot 72 are screwdriver slots 76, normal to the lens receiving slots 72, defining a plane normal to the axis of each shell 15. The lenses 18 each comprise a pair of facing mounting inserts 78 which are inserted in the slots 72, the lenses 48 impaling the lip 66 of the reflector 64 against the lip surface 68. The screwdriver slots 76 allow access to the mounting inserts 78 for removal of the lens 18 and reflector 64 from the shell 15, thus allowing for changing of the lamps 16 disposed in the shells 15. The reflector has a vacuum metalized inside concave surface 80. The lenses 18 are plastic and have a frosted central area 82 to efficiently achieve a directed beam pattern. The lamps 16 are typically 4 volt 5 watt wedge base halogen lamps.

The envelopes 12 have an obliquely truncated surface 88 cutoff at an angle of approximately 45 degrees from a plane normally traversing the cylindrical envelopes 12 to allow the lamp heads 14 to be beamed at an angle from the axis of the tube 10 without blocking the light beam over a limited pivot range. On the outer envelopes 12 closely spaced apart from outermost and circular edges 90, remote from the oblique truncated surface 88, an inwardly extending limit wedge 92 expanding toward the interior of the outer envelopes 12 provides for a limit to the pivoting of the lamp shell 15, beyond a position coaxial with the axis of the tube 10, and generally flush with the end of the outer envelope 12. The shell 15 has a cylindrical surface 94 defining a circumference which is just smaller than the inner circumference of the envelope 12 defined by its inner surface 13, allowing the shell 15 to pivot within the envelope 12. A frustoconical portion 96 of the shell 15 extends inwardly from the cylindrical surface 94 which receives the reflector 64 and lamp 16.

Each envelope 12 has a short inner ledge 100 providing surfaces for engaging the arm 56 of the canopy 11 to limit rotation of the envelopes 12 while allowing limited rotation about the tube 10 to adjust the direction of the lamp beam about the axis of the tube 10. The stops provided by the ledges 100 prevent the installer or user from excessively rotating the outer envelopes 12 and damaging the connecting wires. The envelopes 12 can be squeezed along a diameter normal to the pivot pin aperture 60 axis effectively allowing a slight extention of the distance between the pivot apertures 60, thus allowing the pivot pins 62 of the reflector shell 15 to be inserted in the apertures 60, and then released, thus mounting the shell 15 pivotally within the envelope 12.

With particular reference to FIGS. 2, 3, 4 and 8, the electronic circuitry of the emergency lighting apparatus is modularized both for ease of manufacture and for field installation and repair, and is disposed on the preassembled metal support plate 22 which slides into longitudinal guide tracks 106 along the internal surface of the inner tube 10. The charger board 21 is a printed circuit board 108 extending normal to the support plate 22 and the battery 25. The battery 25 comprises a pair of pure lead sealed cells, mounted generally across the metal support plate 22 so as to evenly dispose their weight about the tube 10. The transformer 23 is generally disposed at one end of the board 21 and the bulk of other components at the other end to more evenly balance the weight of the board 21 on the support plate 22. Thus the plate 22 and its attached components may be preassembled at the factory, yet may be easily removed for field repair.

The battery charger is a 4 volt hysteresis temperature compensated solid state pulse charger which incorporates the 120/277 volt input/charging transformer 23.

A sealed mechanical transfer relay is activated on loss of the 120 volt or 277 volt utility input, which turns the lamps 16 on. To avoid irreparably injuring the batteries, a low voltage disconnect controlled by the circuitry of FIG. 8 disconnects the batteries at approximately 80% of their rated nominal voltage. Thus, rather than allow the lamp to continue to light at lower voltage levels, the lamp will disconnect to prevent damage. UL regulations presently require that the lamps 16 be lit for 90 minutes down to 87 ½% of nominal battery voltage.

The batteries 25 are two (2) 2 volt pure lead, sealed maintenance free cylindrical cells, wired together in series, to produce 4 volts with a capacity of 10 watts for 90 minutes. The electrical connections to the battery are prewired and factory installed to facilitate installation in the field. The battery automatically becomes connected when the male plug 39 from a lamp 16 is inserted into the female receptacle 37 on the end cap 19.

The plugs 39, 40 are positioned on the end caps 19, 20 in the installation of the fixture. In a last step in the manufacturing process, wires leading to the female receptacles 37, 38 are pulled to one side of the tube 10. The end caps 19, 20 which have legs 28 are then placed in to the tube 10. Screws 32 are inserted through countersunk apertures 34 along a diameter of the tube 10 fasten the legs 28 of the end plates 20 to the tube 10. The receptacle 37 on the end cap 19 is a three circuit connector and the receptacle 38 on the end cap 20 is a two circuit connector. Extending from the lamp 16 in the shells 15 are male plugs 39, 40. The plug 39 is a three circuit connector while the plug 40 is a two circuit connector. This facilitates installation, preventing confusion in the field as to the manner in which the plugs are to be connected, since only the two circuit plug 40 will mate with the two circuit female receptacle 38.

In use the lighting fixture can be mounted horizontally or vertically either on the wall or the ceiling, supporting the full weight of the battery and electronics, which weighs on the order of 5 pounds (2.2 kg.).

The tube 10 has a track portion 120 for receiving the longitudinal portion 31 of the canopy 11 as best viewed in FIGS. 2, 3, 4 and 5. The track portion 120 is defined by narrow inwardly directed portions 122 on the inside of the tube 10, and longitudinal substantially juxtaposed portions 124. The juxtaposed portions 124, defined by inwardly directed longitudinal planar integrally molded plates which passing along a chord of the cylindrical tube 10, are spaced apart to form a clearance for electrical wiring and passage of a 4 circuit connector 126. The stick lock 31 is a finishing piece having an elongated portion 130 insertable in the track portion 120 and the small overhang portion 29 locks in place over a cutout surface 134 of the end cap 20 which carries the two circuit plug 38.

Figure 8:
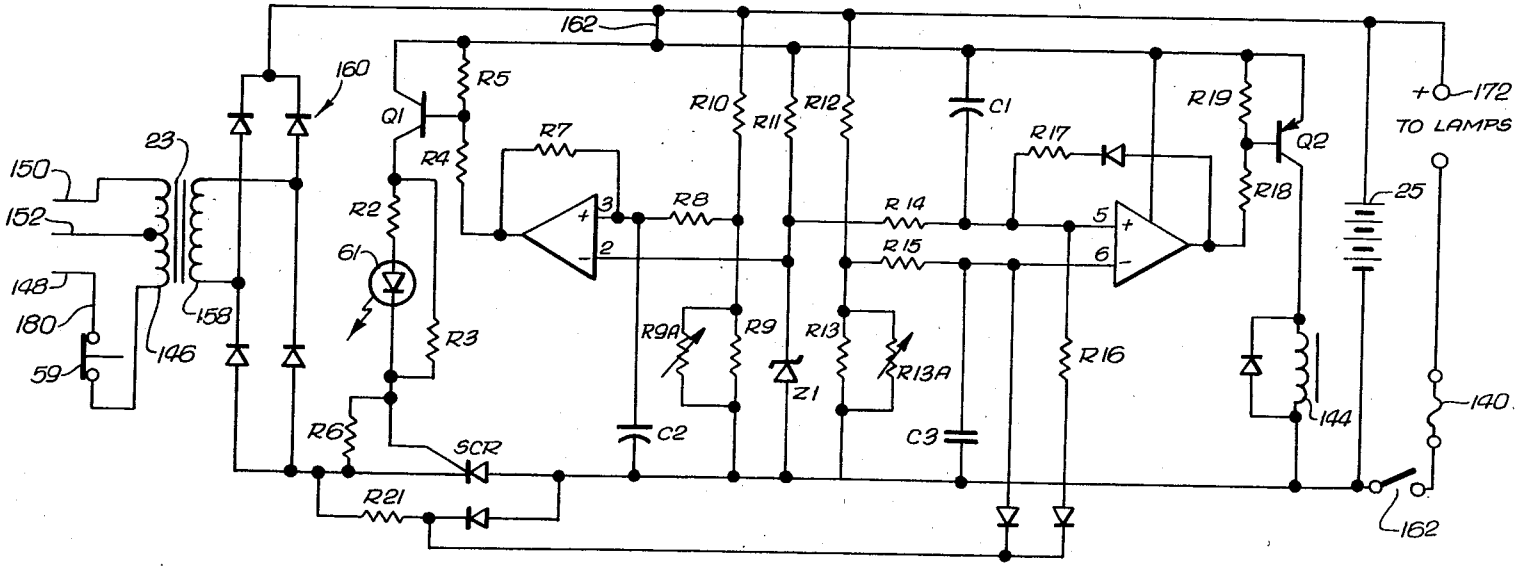
FIG. 8 is a schematic diagram of the electrical circuit of the invention depicted in FIG. 1.

With particular reference to FIG. 8, the circuitry for the lighting fixture is provided by a power supply comprising the battery 25, the two pure lead cells in series, which supplies power to the lamp 16 through the connectors 38. The lamp circuit is fused by a fuse 140, and a switch 162, which are provided by relay contacts of a relay actuated by a relay coil 144, opens the lamp circuit. The objective is to open the lamp circuit when utility current is flowing and applied at the input transformer 23. The input transformer 23 has primary windings coupled to the main power system of the building circuit. The neutral white wire is applied to input 148. In the event the circuit is a 120 volt circuit, then the black wire of the circuit is connected to an input winding connector 150 and if a 277 volt line, the orange wire is connected to wire 152. Normally in the United States, orange, black and white wires from outlet boxes are standard. Pairing black and white wires are standard for 120 volt circuits, while pairing of white and orange are used for 277 volt circuits.

The test switch 59 connected in series to the neutral wire of the input transformer 23 is available to simulate a power outage condition. The secondary windings 158 of the transformer are applied to a full wave bridge 160, which, under appropriate conditions appears across the relay coil 144. The bridge 160 supplies a charging DC current across the battery 25. A jumper couples the battery 25 to a voltage control circuit by way of a mike connector of the receptacle 37 during installation. The jumper connection is not made until field installation to prevent battery drain from the solid state circuit. After installation, however, the line power is generally available for charging the battery 25. The charging circuit will also cause the normally closed relay contact switch 162 (shown open in FIG. 8) controlled by the relay coil 144 to open at such time as the battery falls below approximately 80% of its rated voltage.

For the purpose of presenting a preferred example of this invention, the following component values are given (in ohms or microfarads as applicable):

| | |
|---|---|
| C1 = 470 | R10 = 22K |
| C2 = 4.7 | R11 = 180 |
| C3 = 0.1 | R12 = 12K |
| All diodes: IN4001 | R13 = 33K |
| IC = LM358 | R13A is adjustable |
| Q1 = 2N4355 | R14 = 100K |
| Q2 = 2N4355 | R15 = 47K |
| R2 = 180 | R16 = 22K |
| R3 = 330 | R17 = 47K |
| R4 = 470 | R18 = 470 |
| R5 = 1K | R19 = 1K |
| R8 = 22K | R21 = 180 |
| R9 = 39K | Z1 = 2N5221B |
| R9A is adjustable | |

To install the emergency lighting fixture, a spider plate 170 having a plurality of threaded apertures 171 is fastened with screws to the outlet box of the building structure. The spider plate 170 is used to establish alignment of the canopy 11 and allows 360 degree positioning. The canopy 11 is attached to the spider plate 170 by screws 58 which are disposed in the countersunk apertures 54 of the canopy 11. Of the two AC wires from the outlet box, the neutral or usually white wire is fastened to the available wire 180 of the push to test switch 59, while the black or orange wire (if a 277 volt circuit) is fastened to the extending wire 152 of the 4 circuit plug which is extended through the central aperture 55 of the canopy 11, this being the wire which extends to the input transformer.

The fixtures are manufactured so that when they come from the factory, the canopy 11 is separated from the tube 10 and the end caps 19, 20 are fastened on the tube. The two circuit endcap 20 is notched out to mate with the canopy receiving slot portion 120 on the tube 10. It is not necessary for the installer to open the enclosed tube containing the electronics and the batteries. All that remains to be connected electrically from the tube 10, when received in the field, is the 4 wire plug 126 which extends from the slot.

The canopy 11 is affixed to the spider plate 170, a line wire is married to the switch 59 and the the other line wire is connected to a wire extending through the canopy 11 to the input transformer 23 windings. The extending portion of the arm 56 of the canopy 11 is directed through the slotted portion 120 of the tube 10 and the stick lock 31 follows the elongated extending portion 132 of the arm 56, affixing the canopy 11 to the tube 10. The envelopes 12 may be partly rotated to achieve proper beam positioning about the axis of the tube 10, and adjusted pivotally about pins 62 to achieve proper beam positioning.

As long as utility voltage is present, the red AC pilot light 161 will remain on and the lamps 16 will remain off. As needed, the charging circuit supplies a small charging current to the batteries 25. Upon application of the press to test switch 59, a break in the line voltage is simulated, and this will cause a break in the circuit to the AC pilot light 161 and will cause the charging circuit to engage the relay 144, causing the relay contacts 162 to be closed and closing the circuit to the lamps 16 through the relay contacts 162. On release of the normally closed press to test switch 59, the lamps 16 will again go off. The same operation applies, in the event of an actual loss of power.

Thus, an emergency lighting fixture has been described which is self-contained, simple to install, its beam path is easily adjustable, may be mounted horizontally or vertically on a wall or on a ceiling, decorate in its uniform appearance yet will meet the necessary lighting standards currently required.

It should be noted that single beam lighting fixture are contemplated within the scope of this invention. It is also possible to have a single lamp beam which extends at one end of the tube 10, extending from a single envelope 12, and at the opposite end of the tube, a normally on lamp operating off utility line power. Moreover, it should be noted that it may also be possible to achieve different outer shapes of the envelope, provided that there is an inner cylindrical surface of the envelope which is adjustably rotates about the tube.

While the invention has been described with reference to specific forms thereof, it will be understood that changes and modifications maybe made within the spirit and scope of this invention.

What is claimed is:

1. Emergency lighting apparatus for attachment to a building structure and responsive to an operating condition of a utility line comprising:

housing support means for securing a housing to a structure;

housing means coupled to the housing support means for adjustably supporting a lamp head and encasing a lamp power supply and lamp actuator circuitry;

lamp head means for supplying a an adjustable lighted beam in response to sensing a loss of utility voltage, the lamp head means at least partially enclosed by and coupled to the housing means;

power supply means for powering the lamp head means in event of power outage independently of a utility voltage, the power supply means disposed within the housing means and electrically coupled to the lamp head means; and circuit means for engaging the power supply means to actuate the lamp head means in response to an indication of loss of power, the circuit means disposed within the housing means; and in which the housing means comprises tube means for supporting the power supply means and the circuit means, and envelope means disposed about the tube means for at least partially enclosing the tube means and supporting lamp head means adjacent opposing ends of the housing means, the envelope means providing a decorative appearance to the lighting fixture;

whereby an emergency lighting fixture is provided which retains its power supply and circuitry internal to its housing means which also at least partly encloses the lamp head means, supports the weight of the housing means by the housing support means, and allows light beam positioning.

2. The invention as set forth in claim 1 and in which the housing support means has integrally molded cantilever means for securing the housing means to a supporting surface.

3. The invention as set forth in claim 1 and in which the housing means having a cylindrical outer surface and the envelope means having an inner cylindrical surfaces mating with the cylindrical outer surface of the tube means, the cylindrical envelope means at least partially rotatable about the tube means for adjusting the positioning of the lamp head means axially about the tube means whereby even as the envelope is rotated to adjust the beam position, the exterior shape and appearance is substantially maintained.

4. The invention as set forth in claim 3 and in which the cylindrical envelope means includes means for pivotally retaining the lamp head means.

5. The invention as set forth in claim 4 and in which the envelope means comprising two envelopes disposed in juxtaposition; and comprising means for engaging the power supply means to actuate the lamp head means in response to an indication of a break in line voltage and for charging the power supply means on demand, the tube means having end means for substantially enclosing each end of the tube means.

6. The invention as set forth in claim 5 and in which the end means comprise ventilation aperture means for allowing air to pass through ends of the tube means, the end means having circumferential groove means for receiving rotational guide means;

guide means disposed within the envelope means for engaging the circumferential groove means of the end means, allowing the envelope to rotate about the tube and fixing the lateral positioning of the envelope means about the tube means.

7. The invention as set forth in claim 5 and in which the housing support means comprising test switch means for simulating a break in line current and pilot light means for indicating the presence of a line voltage.

8. Emergency lightling apparatus comprising:

canopy means for securing a housing to an electrical outlet box;

the canopy means having a cantilever arm for supporting a housing;

a housing supporting emergency lighting apparatus for actuating a light beam in response to an indication of a loss of utility voltage, the housing being coupled to the canopy means for retaining battery means and and electronics for powering lamp means and supporting lamp head means;

the housing comprising a cylindrical tube and two cylindrical envelopes disposed in juxtaposition on the tube adjacent opposite sides of the cantilever arm of the canopy means; the envelopes remotely supporting lamp heads, the envelopes substantially enclosing the tube and rotatable about the tube for adjusting the positioning of the lamp heads axially about the housing, the envelopes providing a decorative appearance to the lighting fixture;

lamp heads pivotally coupled at opposing ends of the envelopes remote from the cantilevered protrusion of the canopy for providing an adjustable light beam;

battery means for powering the lamp head means in the event of power outage, the battery means disposed within the tube; and means for engaging the battery means and actuating the lamp head means in response to an indication of loss of power;

whereby an emergency lighting fixture is provided having a uniform outer appearance irrespective of beam positioning, yet retains the battery and electronics internal to the cylinder, supports the weight of the lighting fixture by the canopy and allows adjustment of lighting positioning, yet may be simple to install as a result of preinstallation of components within the tube.

9. The invention as set forth in claim 8 and in which the cantilever arm of the canopy terminates in a protruding portion, the tube having a slotted portion and the protruding portion is movable longitudinally along the slotted portion of the tube to engage the tube and support the tube.

10. The invention as set forth in claim 9 and comprising stick lock means comprising a longitudinal portion moveable within the slotted portion of the tube to bear on the protruding portion of the canopy and lock the protruding portion within the tube.

11. The invention as set forth in claim 10 and in which the lamp heads each comprising a shell and a reflector centrally disposed within the shell, a lamp disposed within the reflector and a lens extending forward of the lamp, the lens means comprising a central frosted portion.

12. The invention as set forth in claim 10 and comprising a wedge, the lamp shells each having a frustoconical surface extending inwardly toward the tube, the wedge extending from the interior of the envelope and engaging a frustoconical surface of the lamp shell for limiting the rotational travel of the shell.

13. The invention as set forth in claim 10 and comprising switch means disposed on the canopy for testing the batteries and simulating a power outage event.

14. The invention as set forth in claim 10 and in which the plug entering the first lamp head comprising two leads and the plug entering the second lamp head comprising other than two leads, whereby the positioning of the lamps is polarized, preventing mistakes in installation.

15. Emergency lighting apparatus for attachment to a building structure and responsive to an operating condition of a utility line comprising:

a canopy for securing a housing to a structure;

housing means coupled to the canopy for adjustably supporting a lamp head means, the housing means comprising tube means for supporting power supply means and circuit means, and envelope means disposed over the tube means for at least partially enclosing the tube means and supporting lamp head means adjacent opposing ends of the housing means, the envelope means providing a decorative appearance to the lighting fixture, the tube means having a cylindrical outer surface and the envelope means having an inner cylindrical surfaces mating with the cylindrical outer surface of the tube means, the cylindrical envelope means at least partially rotatable about the tube means for adjusting the positioning of the lamp head means axially about the tube means;

lamp head means for supplying a an adjustable lighted beam in response to sensing a loss of utility voltage, the lamp head means at least partially enclosed by and coupled to the envelope means;

power supply means for powering the lamp head means in event of power outage independently of a utility voltage, the power supply means disposed within the tube means and electrically coupled to the lamp head means; and circuit means for actuating the power supply means to actuate the lamp head means in response to an indication of loss of power, the circuit means disposed within the housing means;

whereby an emergency lighting fixture is provided which retains its power supply and circuitry internal to its housing, supports the weight of the housing by the housing support means, and allows light beam positioning.

16. The invention as set forth in claim 15 and in which the canopy has an integrally molded cantilever arm for securing the housing means to a supporting surface and integrally molded lugs extending inwardly and joined to a spider plate for supporting the weight of the housing means.

17. The invention as set forth in claim 15 and comprising:

a spider plate for securing the canopy to an electrical outlet box;

the canopy having a plurality of integrally molded lugs having longitudinal apertures, longitudinal fasteners for securing the canopy to the spider plate, and an integrally molded cantilever arm for supporting a housing; and a housing supporting emergency lighting apparatus for actuating a light beam in response to an indication of a loss of utility voltage.

18. The invention as set forth in claim 17 and in which the longitudinal apertures defining a countersunk screw head receiving surface, and machine screw means disposed within the apertures and engaging the spider plate.

19. The invention as set forth in claim 15 and in which the envelope means comprising two cylindrical envelopes disposed in juxtaposition;

the tube means comprising a slotted portion and the cantilever arm of the canopy having a protruding portion engaging and movable within the slotted portion to affix the canopy to the tube means; and stick lock means for confining protruding portions of the arm of the canopy centrally within the tube means and the two envelopes substantially enclosing the tube means about and adjacent the arm of the canopy.

20. The invention as set forth in claim 19 and in which the envelopes comprising means for pivotally retaining the lamp head means in opposing spaced apart relationship, the lamp head means rotatable about two perpendicular axes, and limit means for limiting rotation of the lamp head means about the perpendicular axes.

21. The invention as set forth in claim 20 and comprising means for engaging the power supply means to actuate the lamp head means in response to an indication of a break in line voltage and for charging the power supply means on demand, the tube means having end means for substantially enclosing each end of the tube means, the end means comprising ventilation aperture means for allowing air to pass through ends of the tube means, the end means having circumferential groove means for receiving rotational guide means;

guide means disposed within the envelope means for engaging the circumferential groove means of the end means, allowing the envelope to rotate about the tube and fixing the lateral positioning of the envelope means about the tube means.

22. The invention as set forth in claim 21 and comprising circuit plate means for supporting electronic circuitry, battery means and transformer means, and means disposed within the tube means for retaining the plate means, emergency lighting circuit means including a transformer and battery means disposed within the tube means supported by the circuit plate means.

23. The invention as set forth in claim 22 and comprising plug means coupling the lamp head means to circuitry of the tube means and connection means for energizing the circuitry disposed within the tube means, whereby a battery may be factory packed within the tube means without significant circuit drain until field installation of the apparatus.

24. The invention as set forth in claim 23 and in which the lamp head means comprising lamp shell means for pivotally supporting a lamp and reflector arrangement, the shell means having outermost portions, the lamp shell means comprising pivot elements extending diametrically across the outermost portion of the shell means, the envelope means defining an oblique truncated surface, whereby the shell is at least partially rotatable within the pivot elements through apertures in the tube means to adjust the beam of the lamp head about an axis normal to the tubing axis.

* * * * *